US007480967B2

(12) United States Patent
Kojoori et al.

(10) Patent No.: US 7,480,967 B2
(45) Date of Patent: Jan. 27, 2009

(54) REMOVABLE FASTENER APPARATUS AND METHOD OF USE

(75) Inventors: Ramineh Kojoori, Plano, TX (US); Luk Kwok Wah, Kowloon (HK)

(73) Assignee: Fossil, Inc., Richardson, TX (US)

( * ) Notice: Subject to any disclaimer, the term of this patent is extended or adjusted under 35 U.S.C. 154(b) by 0 days.

(21) Appl. No.: 11/036,807

(22) Filed: Jan. 14, 2005

(65) Prior Publication Data

US 2005/0217080 A1 Oct. 6, 2005

Related U.S. Application Data

(60) Provisional application No. 60/558,669, filed on Apr. 1, 2004.

(51) Int. Cl.
*A44B 11/25* (2006.01)
*A41F 9/00* (2006.01)

(52) U.S. Cl. ..... 24/163 R; 24/265 BC; 24/194; 2/322

(58) Field of Classification Search ..... 24/365 WS, 24/589.1, 590.1, 265 BC, 702, 171, 194, 24/265 EC, 163 R; 2/322
See application file for complete search history.

(56) References Cited

U.S. PATENT DOCUMENTS

| | | | | | |
|---|---|---|---|---|---|
| 1,525,424 | A | * | 2/1925 | King | 24/265 BC |
| 3,799,610 | A | * | 3/1974 | Hollins | 297/468 |
| 4,217,681 | A | * | 8/1980 | Grohoski et al. | 24/265 WS |
| 4,281,440 | A | * | 8/1981 | Britz | 24/191 |
| 4,406,043 | A | * | 9/1983 | Friedman | 24/171 |
| 4,419,792 | A | * | 12/1983 | Kohli | 24/170 |
| 5,410,784 | A | * | 5/1995 | Katz | 24/587.1 |
| 5,638,342 | A | | 6/1997 | Kartsotis et al. | |
| 5,689,867 | A | * | 11/1997 | Katz | 24/587.1 |
| 5,914,913 | A | * | 6/1999 | Shriqui | 368/282 |
| 6,014,793 | A | * | 1/2000 | Howald | 24/265 B |
| 6,237,319 | B1 | | 5/2001 | Amundsen et al. | |
| 6,298,650 | B1 | | 10/2001 | Amundsen et al. | |
| 6,389,653 | B1 | * | 5/2002 | Matoba | 24/265 BC |
| 6,418,706 | B1 | | 7/2002 | Kit | |
| D461,737 | S | | 8/2002 | Fong Pui Ching | |
| 6,467,134 | B1 | * | 10/2002 | Stroud | 24/163 R |

* cited by examiner

*Primary Examiner*—Robert J Sandy
(74) *Attorney, Agent, or Firm*—Fish & Richardson P.C.

(57) ABSTRACT

A removable buckle assembly includes a base member having a male portion and a buckle attachment. The buckle attachment includes a female portion adapted to receive the male portion to removably couple the buckle attachment to the base member.

18 Claims, 6 Drawing Sheets

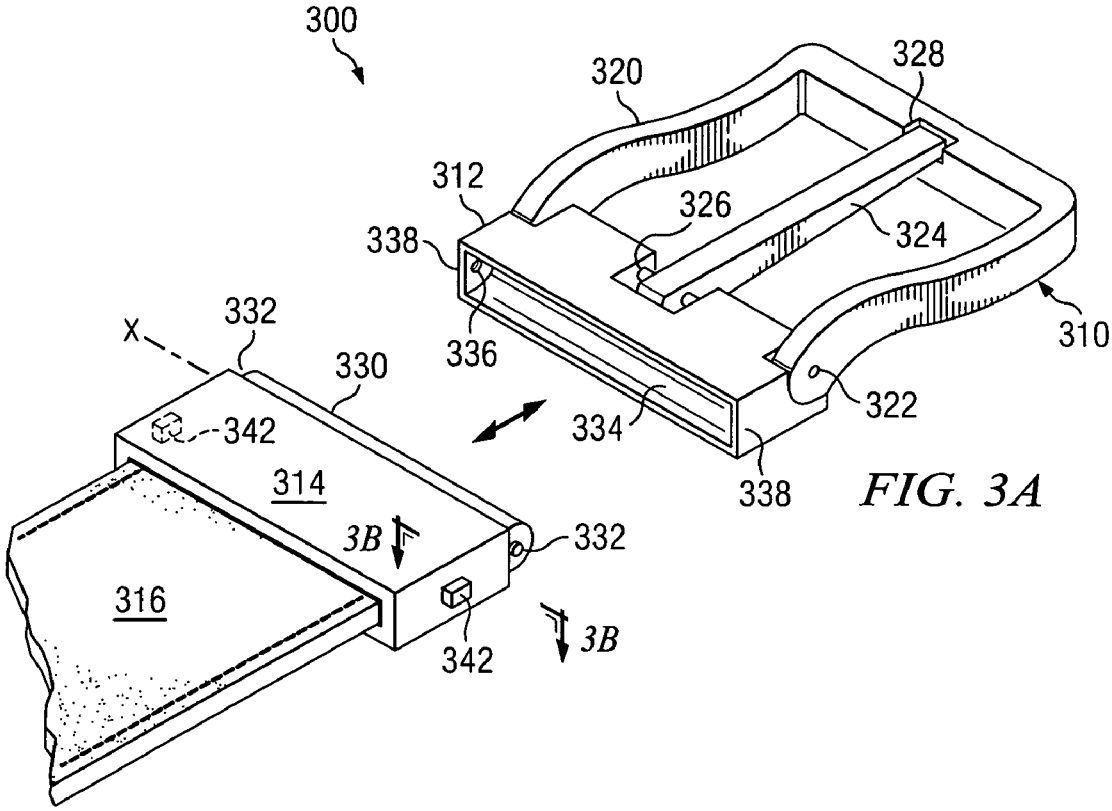
FIG. 3A
FIG. 3B
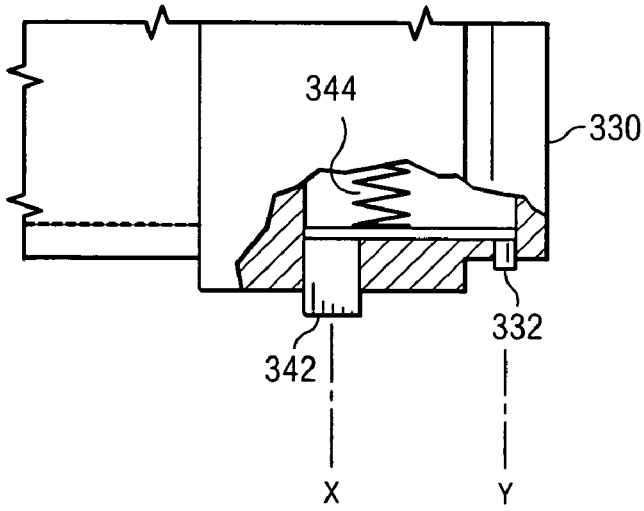

REMOVABLE FASTENER APPARATUS AND METHOD OF USE

This application claims the benefit of U.S. Provisional Application No. 60/558,669, filed Apr. 1, 2004. The disclosure of the prior application is considered part of (and is incorporated by reference in) the disclosure of this application.

TECHNICAL FIELD

This invention relates to apparel, and more particularly to a fastener with a removable strap or belt and associated method of use.

BACKGROUND

Belts, watches, bracelets and other fashion accessories have become an almost indispensable accoutrement to everyday attire. More and more fashion experts focus on the belt as a necessary piece of the puzzle when assembling an outfit. Watches and bracelets are also widely selected as accessories by consumers based on the appearance of the accessory and the ability of the accessory to aesthetically accent other attire to be worn by the consumer. Furthermore, belts are often necessary to ensure that clothing remains properly placed on the person wearing the belt. Belts are generally fabricated with a buckle that allows a portion of a belt to pass through or adjacent to the buckle so that a portion of the buckle, such as a buckle pin or tine, retains the belt about the wearer's waist. Watches and bracelets may be made by a variety of materials, and generally include a band or similar portion that wraps around the wearers wrist or ankle.

As fashion becomes more and more relevant to purchase decisions regarding belts, watches, and bracelets (collectively "accessories"), many accessory manufacturers and sellers provide accessories that are reversible and/or have exchangeable buckles, straps and/or other components. Previous exchangeable accessory components have required wearers to completely remove the leather or fabric "belt" or "strap" portion from the "buckle" portion, which can be time consuming and frustrating due to the methods used to attach the buckles to the belts. Additionally, reversible belts and watchbands often have an unsightly seam or "wraparound" portion that shows some portion of a first side of the belt when the second side of the belt or watchband is desired to be predominantly shown.

SUMMARY

In one embodiment of the present invention, a fastener assembly includes a first stock with a first coupling receiver that includes a female portion. A first base member is coupled to a strap, that includes a male portion adapted to be slidably coupled to the first coupling receiver. A detent is adapted to seat the first base member proximate to the first stock. The fastener assembly may include a watch assembly having a first stock. The watch assembly may include a second stock that has a first coupling receiver with a female portion, a second base member coupled to a strap including a male portion adapted to be slidably coupled to the second stock. The fastener assembly may be part of a watch assembly, a suspender assembly, a belt assembly, or other fashion accoutriment.

A method for providing a removable buckle assembly includes providing a base member coupled to a belt that has a male portion and a detent. The method also includes providing a buckle attachment having a female portion adapted to receive the male portion of the base member. An alternate embodiment includes providing a base member coupled to a belt that has a female portion. The method also includes providing a buckle attachment that includes a male portion adapted to slidably or insertably couple the buckle attachment to the base member.

An advantage of various embodiments is the ability to quickly and efficiently exchange one buckle attachment for another. Yet another advantage is the ability to provide a reversible belt that has substantially identical characteristics regardless of which surface of the belt is exposed.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 3A is a perspective view of an alternate buckle assembly according to an embodiment of the present invention.

FIG. 3B is an enlarged view of a portion of the alternate buckle assembly illustrated in FIG. 3A.

Like reference symbols in the various drawings indicate like elements.

DETAILED DESCRIPTION

Figure 1A:
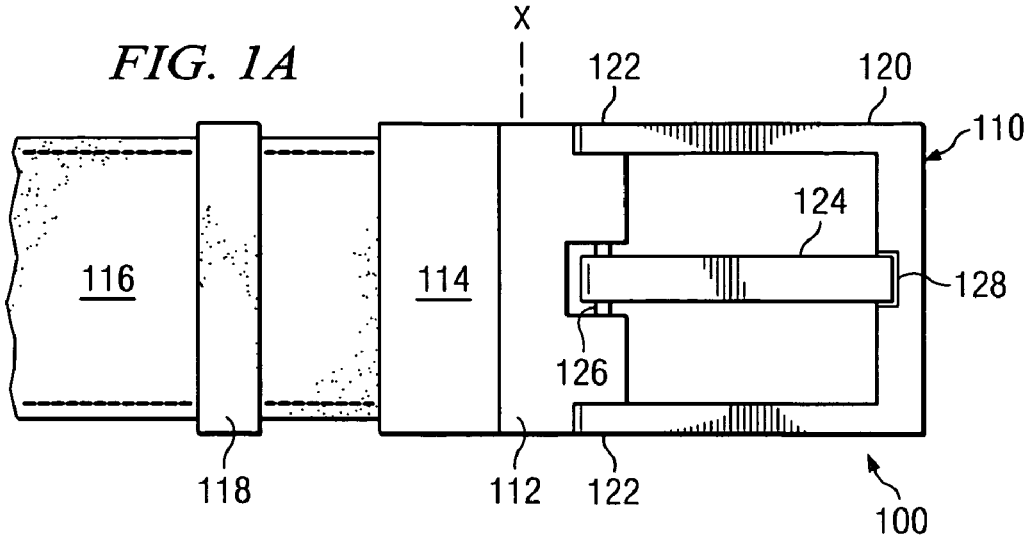
FIG. 1A is a plan view of an assembled buckle assembly according to an embodiment of the present invention.

Referring to FIG. 1A, a buckle assembly 100 includes a buckle attachment 110 and a base member 114 coupled to a belt 116. The buckle attachment 110 includes a buckle stock 112, a buckle frame 120, and a buckle pin 124. The buckle frame 120 may be coupled to the buckle stock 112 with the at least one hinge 122. Additionally, the buckle pin 124 may be coupled to the buckle stock 112 via a pin bearing 126. The buckle frame 120 may also include a pin seat 128 that is adapted to maintain the buckle pin 124 in a secured position when the buckle pin 124 is inserted through a hole in the tongue of the belt 116 that is inserted through the buckle frame 120 for securing the belt 116 (not explicitly shown).

Figure 1B:
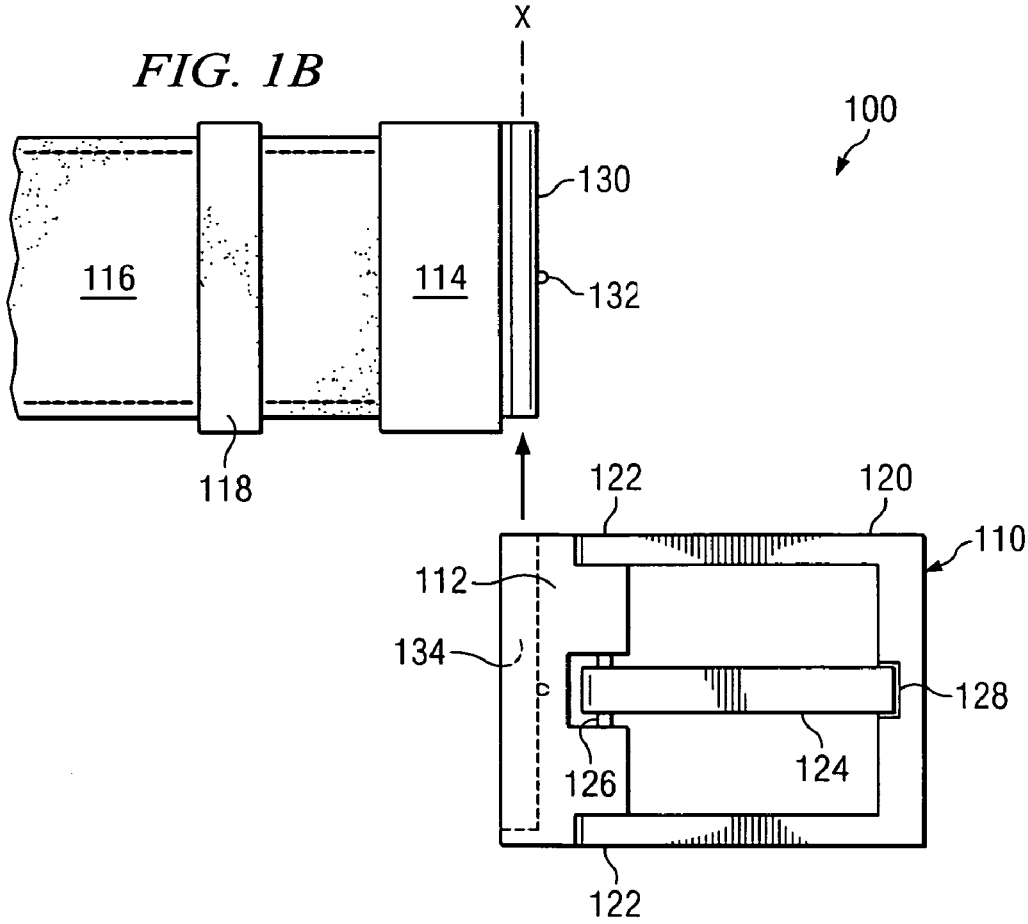
FIG. 1B is a plan view of an unassembled buckle assembly of FIG. 1A.

Referring now to FIG. 1B, the buckle assembly 100 of FIG. 1A is shown with the buckle stock 112 removed from the base member 114. Accordingly, additional features of the buckle stock 112 and the base member 114 are illustrated. In the embodiment shown, the buckle stock 112 includes a female portion 134 that is adapted to receive a male portion 130 of the base member 114. Additionally, the male portion 130 may include a detent 132 to provide assistance in maintaining the relative positions of the buckle stop 112 and the base member 114 when the male portion 130 of the base member 114 is inserted into the female portion 134 of the buckle stock 112.

Figure 2A:
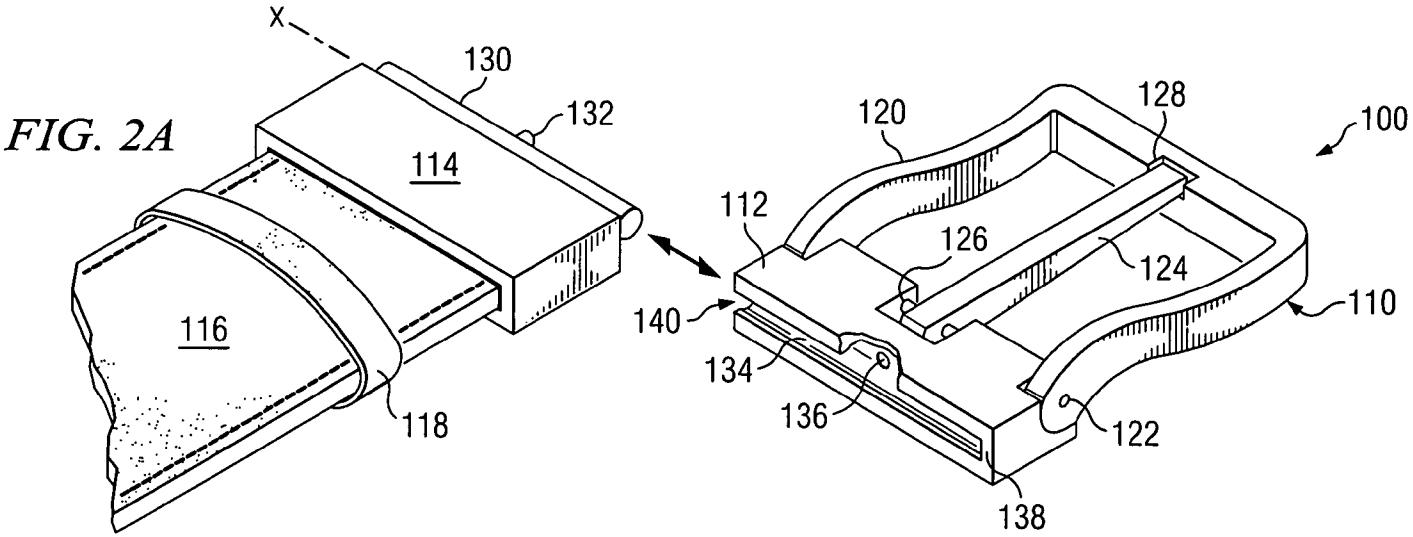
FIG. 2A is a perspective view of the buckle assemblies of FIGS. 1A and 1B.

FIG. 2A illustrates a perspective view of the buckle assembly 100 to further illustrate features of a buckle assembly according to an embodiment of the present invention. Additional features illustrated by FIG. 2A include a detent retainer 136 which may be formed in the female portion 134 of the buckle stock 112. During operation, the base member 114 may be slidably or insertably coupled into the buckle stock 112 to removably couple the buckle attachment 110 to the base member 114. The detent 132 may be movably biased inward or toward the belt 116, in response to pressure from the female portion 134 of the buckle stock 112. The detent 132 may be adapted to fit into the detent retainer 136 when the male portion 130 of the base member 114 is completely inserted into the female portion 134 of the buckle stock 112 of the buckle attachment 110.

The detent 132 may be movably biased inward and outward by any suitable mechanism. For example, a spring may be placed within the base member 114 adjacent to the detent 132 to provide a resistance to an inward bias of the detent 132 based on force exerted by the female portion of the buckle stock 112 when the male portion 130 of the base member 114 is inserted into the female portion 134 of the buckle stock 112. In the embodiment shown, the male portion 130 of the base member 114 may be slidably coupled within the female portion 134 of the buckle stock 112 along an X-axis that corresponds to the longitudinal axis of the male portion 130 and the female portion 134. Additionally, a stock stop 138 that prevents movement of the male portion 130 through the entire female portion 134 of the buckle stock 112 may be included as part of the buckle stock 112. Alternatively, the stock stop 138 may not be present such that the female portion 134 extends the entire distance along the X-axis of the buckle stock 112, thus allowing the male portion 130 of the base member 114 to pass completely through the female portion 134 of the buckle stock 112. In such an embodiment, the buckle attachment 110 may be coupled to the base member 114 from any direction along the X-axis. When the stock stop 138 is present in the buckle stock 112, the buckle attachment 110 may only be inserted through a single female aperture 140 of the female portion 134 for insertably coupling the male portion 130 into the female portion 134.

Figure 2B:
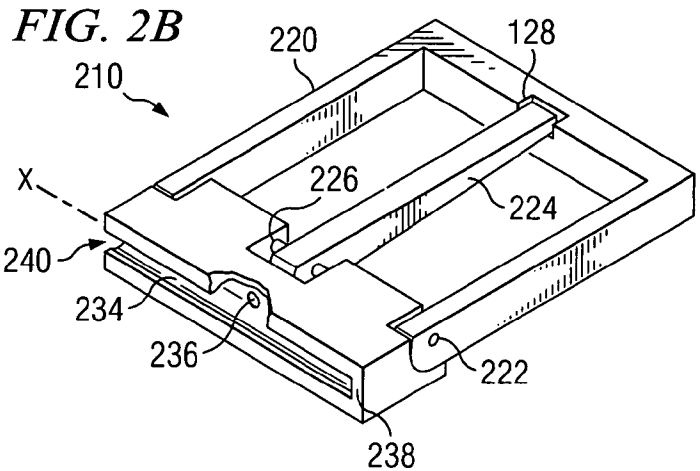
FIG. 2B is a perspective view of an alternate buckle assembly according to an embodiment of the present invention.

In addition to the buckle attachment 110, which may be slidably or insertably attached to the base member 114, FIG. 2B illustrates an additional, or alternative, buckle attachment 210 that may be slidably or insertably coupled to the base member 114. In the embodiment shown, the buckle attachment 210 includes similar features to those of the buckle attachment 110 of FIG. 2A. However, the buckle frame 220 may be formed in an alternate shape, color, and/or material than the buckle frame 120 of FIG. 2A. Such an alternative design allows a user or wearer to change the appearance of the buckle by merely changing the buckle attachment 210 or 110 that is coupled to the base member 114 without having to change the belt 116. Alternatively, the buckle attachment 210 may be fashioned from a different colored material than the buckle attachment 110. For example, if the buckle attachment 110 is fashioned out of a silver material, a user desiring to wear a gold buckle attachment as a fashion accessory may elect to remove the buckle attachment 110 from the base member 114 and replace it with a buckle attachment 210 of similar dimensions, yet having a different color that is adapted to be coupled to the base member 114 as described above.

In the embodiment shown in FIG. 2A, the male portion 130 of the base member 114 is substantially cylindrical in shape, and is adapted to be insertably coupled into a substantially cylindrically-shaped female portion 134 of the buckle stock 112. Alternatively, the male portion 130 of the base member 114 may be formed in any suitable shape other than a substantially cylindrical shape. For example, the male portion 130 of the base member 114 may be formed in an elongated polyhedron shape, similar to that of the surface of a common wooden pencil, thus having the cross-action of a hexagon, octagon or any other noncircular geometric shape, provided that the male portion 130 of the base member 114 is adapted to be insertably coupled to the female portion 134 of the buckle stock 112.

Referring to FIG. 3A, an alternative embodiment of a buckle assembly 300 is shown. The buckle assembly 300 includes a buckle attachment 310, a buckle stock 312, and a base member 314 coupled to a belt 316. In the embodiment shown, the male portion 330 of the base member 314 may be inserted into the female portion 334 of the buckle stock 312 along a Y-axis. Detents 332 may be provided to be inserted into detent retainers 336 formed in stock stops 338 of the buckle stock 312. Additionally, detent buttons 342 may be present, enabling a user to depress the detent buttons 342 in order to force the detents 332 inward to allow the male portion 330 to be inserted into the female portion 334 of the buckle stock 312. Upon releasing the detent buttons 342, the detents 332 are allowed to move along the X-axis outward into detent retainers 336 to securely couple the buckle attachment 310 to the base member 314.

As shown in FIGS. 3A and 3B, the detent buttons 342 may be coupled to the detents 332 via a spring member 344. The spring member 344 may allow a user to depress the detent buttons 342 inwardly along an X'-axis. When the detent buttons 342 are depressed, the detents 332 are biased inwardly toward one another along the X-axis to allow the male portion 330 of the base member 314 to be inserted into the female portion 334 of the buckle stock 312 shown in FIG. 3A. Additionally, a user may depress the detent buttons 342 inwardly, thus biasing the detents 332 inwardly to allow the detents 332 to be removed from the detent retainers 336 (FIG. 3A) to allow the male portion 330 of the base member 314 to be removed from the female portion 334 of the buckle stock 312, as shown in FIG. 3A.

Figure 4:
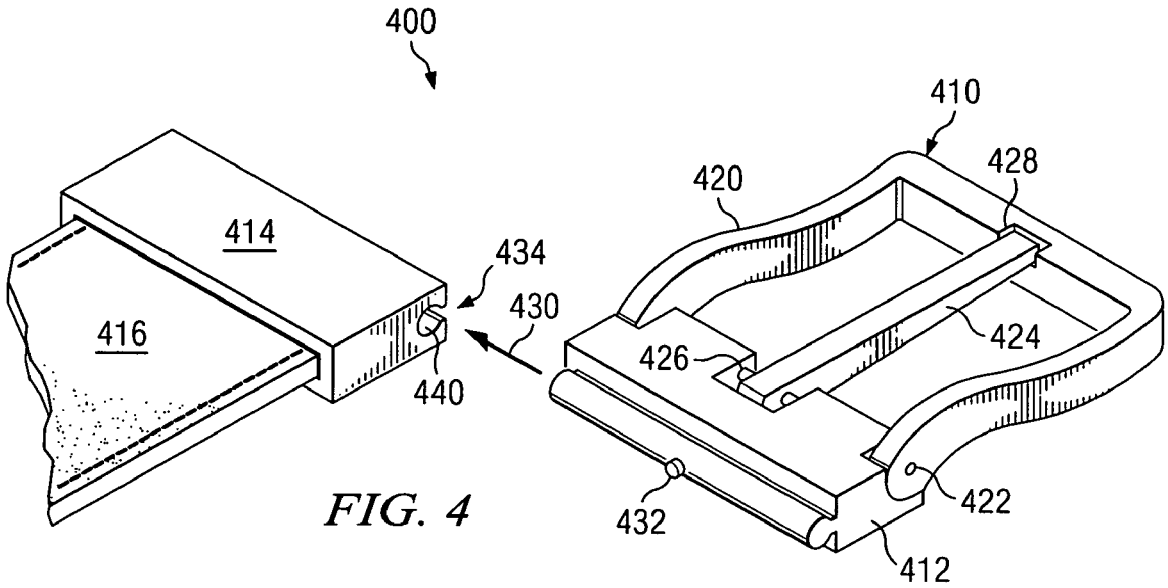
FIG. 4 is a perspective view of an alternate buckle assembly according to an embodiment of the present invention.

FIG. 4 illustrates an alternative buckle assembly 400. Buckle assembly 400 includes a buckle attachment 410, which may have a buckle stock 412, a buckle frame 420, a buckle pin 424 coupled to the buckle stock 412 via a pin bearing 426 and may be adapted to rest in a seat 428 formed in the frame 420. Additionally, the buckle stock 412 may include a male portion 430 and a detent 432. A base member 414 may be coupled to a belt 416. The base member 414 includes a female portion 434 and has a female portion aperture 440 adapted to allow the male portion 430 to be inserted through the female portion aperture 440 so that the female portion 434 may receive the male portion 430 to removably couple the buckle attachment 410 to the base member 414.

Figure 5:
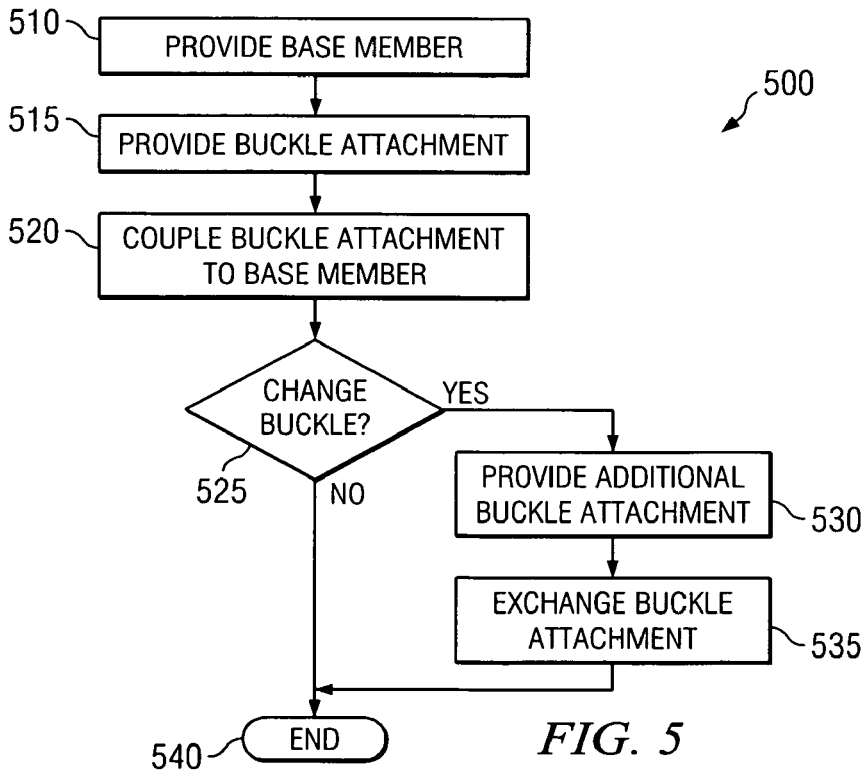
FIG. 5 is a flow chart of the steps associated with a method according one embodiment of the present invention.

FIG. 5 illustrates the steps associated with one embodiment of a method 500 for providing and/or using a buckle assembly according to an embodiment of the invention. At step 510, a base member is provided; the base member may be coupled to a belt. At step 515, a buckle attachment is provided. The buckle attachment may be removably coupled to the base member in a manner disclosed above with respect to FIGS.

1-4, or in any suitable manner consistent with the structures, methods, and techniques disclosed herein. At step 520, the buckle attachment is removably coupled to the base member. At step 525, the buckle attachment may be exchanged with a second buckle attachment. If no exchange is necessary, then at step 540, the method is complete. If exchange is necessary at step 525, then at step 530 an additional buckle attachment is provided. At step 535, the first buckle assembly is exchanged with the second buckle assembly by removing the first buckle assembly from the base member and removably coupling the second buckle assembly to the base member. At step 540, the process is complete.

Embodiments of the buckle assemblies described above may be additionally or alternatively applied to other fashion accessories, including, but not limited to watches, bracelets, necklaces, or other suitable accessories. Accordingly, the following embodiment of a watchband fastener assembly may be implemented in a belt buckle or necklace as well as the watchband embodiment shown.

Figure 6A:
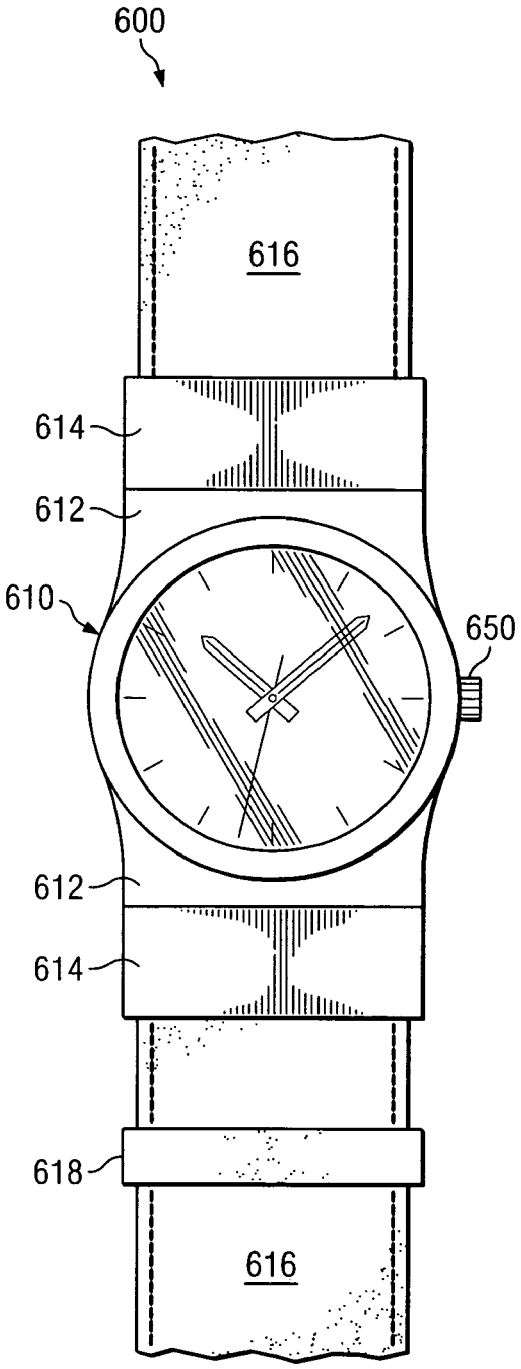
FIG. 6A is a top plan view of a watch fastener assembly according to an embodiment of the present invention.
Figure 6B:
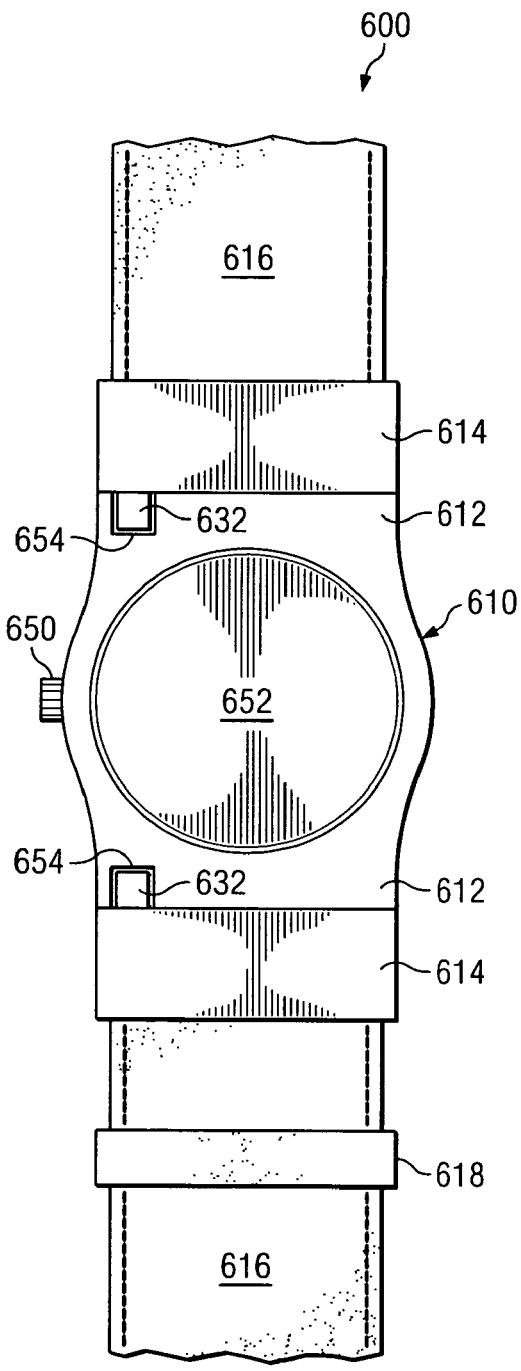
FIG. 6B is a bottom plan view of the watch fastener assembly of FIG. 6B.

FIGS. 6A and 6B illustrate a watch assembly 600. The watch assembly 600 includes a watch body 610, one or two watch stocks 612, and at least one strap 616. The at least one strap 616 may be operable individually or, in the case of two watch straps 616, together to secure the watch assembly 600 about the arm, leg, or other suitable location (not shown) of a wearer. Each of the at least one strap 616 is coupled to a base member 614. As illustrated in FIG. 6B, the watch assembly 600 may include a backplate 652. Additionally, a detent 632 may be disposed within a detent housing 654. As discussed below with respect to FIGS. 7A and 7B, the detent 632 may be adapted to secure one of the base members 614 to one of the watch stocks 612.

Figure 7A:
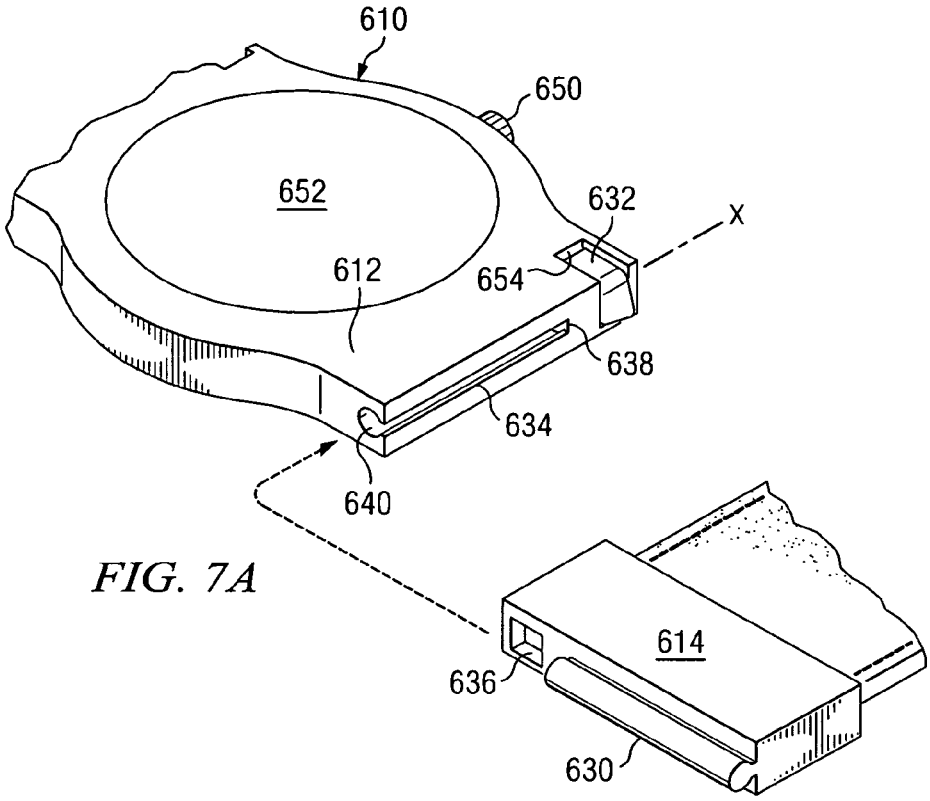
FIG. 7A is a perspective view of the watch fastener assembly of FIG. 6B, unassembled.
Figure 7B:
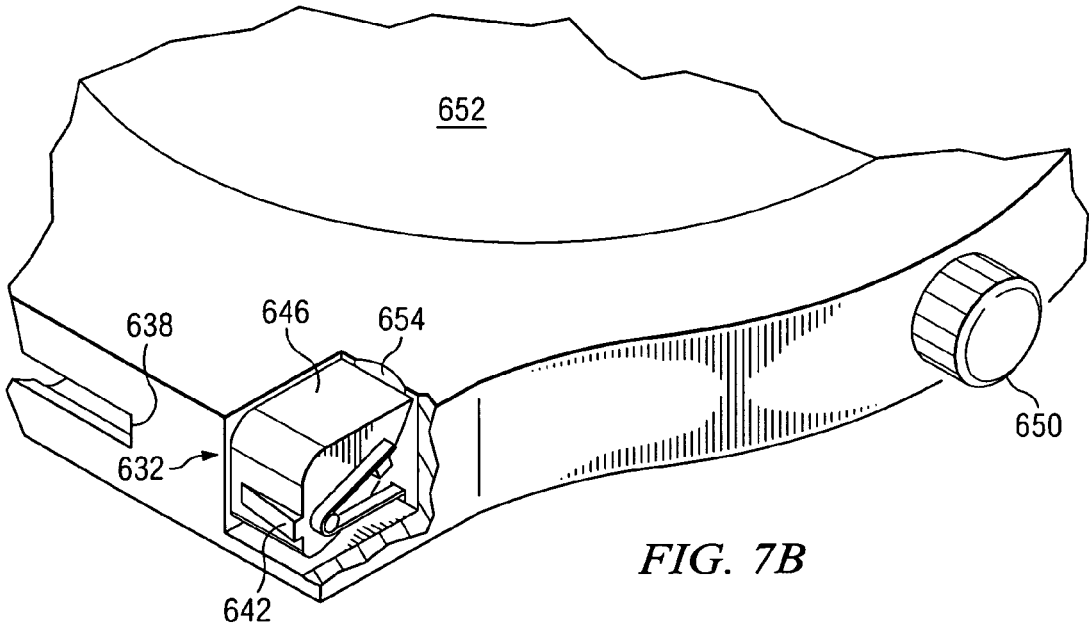
FIG. 7B is a perspective opposite view of a portion of the watch fastener assembly of FIG. 7A.

FIGS. 7A and 7B illustrate a portion of the watch body 610 with an at least one strap 616 detached from the watch stock 612. The base member 614 may include a male portion 630 adapted to be inserted into a female aperture 640 of a female portion 634 formed within or coupled to the watch stock 612. Additionally, the base member 614 may include a detent recess 636. The watch stock 612 may also include a stock stop 638 to prevent the male portion 630 of the base member 614 from sliding through the female portion 634 of the watch stock 612.

In operation, the male portion 630 of the base member 614 may be inserted into the female portion 634 of the watch stock 612 through the female aperture 640 along an X-axis. The lead edge of the base member 614 may engage the detent 632. As illustrated in FIG. 6B, the detent 632 may include a detent lever 646, a detent spring 644, which may be a coil spring, leaf spring, or other suitable spring device, and a detent projection 642. The detent projection 642 may be a male portion that is adapted to be inserted into the detent recess 636. Additionally, the detent projection 642 may be sloped or slanted such that the lead edge of the base member 614 engages the detent 632 and the detent projection 642 as the base member 614 is slid into place opposite the watch stock 612.

As the base member 614 is slid into place, the sloped detent projection 642 causes the base member 614 to bias the detent 632 against the force of the detent spring 644 until the base member 614 is fully juxtaposed with the watch stock 612, which may be when the male portion 630 of the base member 614 abuts the stock stop 638. Additionally, upon complete insertion of the male portion 630 unto the female portion 634, the detent recess 636 may be positioned opposite the detent projection 642, thus allowing the detent projection 642 to be inserted into the detent recess 636. The detent projection 642 may be inserted into the detent recess by manual manipulation of the detent 632. Additionally or alternatively, the detent projection 642 may be forcibly inserted into the detent recess 636 by the force of the detent spring 644.

In addition to the embodiments described above with respect to the watch assembly 600, the watch assembly 600 may be adapted to operate upon the same principles and with similar components as described above with respect to embodiments of the buckle assembly illustrated and described with respect to FIGS. 1A-5. Additionally, other types of jewelry and/or fashion accessories may implement the principles disclosed herein without departing from the spirit and scope of the invention. Accordingly, bracelets, anklets, necklaces, suspenders, and other fashion accessories may implement the exchangeable straps, buckles and clasps described above.

A number of embodiments of the invention have been described. Nevertheless, it will be understood that various modifications may be made without departing from the spirit and scope of the invention. For example, the buckle frame and buckle stock may be a unitary buckle structure such that a male or female portion is formed in the buckle structure corresponds to the female or male portion, respectively, in the base member. Accordingly, other embodiments are within the scope of the following claims.

What is claimed is:

1. A buckle assembly for coupling to a belt, the belt for wearing around a waist of a wearer, the buckle assembly comprising:

a base member including a male portion, the base member independently coupled to the belt at a distal end of the belt; and a buckle attachment comprising a lateral side and a longitudinal side, the buckle attachment including a female portion disposed on at least a portion of the longitudinal side, wherein the base member is removably coupled to the buckle attachment by slidably coupling the male portion of the base member and the female portion of the buckle attachment along an axis defined by a longitudinal axis of the female portion, and wherein the longitudinal axis of the female portion extends along the longitudinal side of the buckle attachment, and wherein the buckle attachment is adapted to releasably secure to the belt for fastening the belt around the waist of the wearer.

2. The buckle assembly of claim 1, further comprising a detent coupled to the base member, the detent adapted to be inserted into a detent recess formed in the female portion, the detent operable with the detent recess to resist uncoupling of the base member from the buckle attachment, the base member is slidably coupled to the buckle attachment.

3. The buckle assembly of claim 2, wherein the base member further comprises a detent spring, the detent spring adapted to bias the detent toward the detent recess when the base member is coupled to the buckle attachment.

4. The buckle assembly of claim 2, further comprising a detent actuator adapted to bias the detent along the longitudinal axis defined by the female portion of the buckle attachment, the biasing of the detent operable to release the detent from the detent recess.

5. The buckle assembly of claim 4, further comprising a detent spring adapted to bias the detent toward the detent recess when the base member is coupled to the buckle attachment.

6. The buckle assembly of claim 1, wherein the female portion is substantially cylindrical, and wherein the male portion is substantially cylindrical.

7. The belt assembly of claim 1, wherein the longitudinal axis is parallel to the longitudinal side of the buckle attachment.

8. The buckle assembly of claim 1, wherein the buckle attachment further comprises:

a buckle stock comprising a lateral side and a longitudinal side, the buckle stock including a female portion disposed on at least a portion of the longitudinal side, wherein the base member is removably coupled to the buckle attachment by slidably coupling the male portion of the base member and the female portion of the buckle stock along an axis defined by a longitudinal axis of the female portion, and wherein the longitudinal axis of the female portion extends along the longitudinal side of the buckle stock;

a buckle pin coupled to the buckle stock, the buckle pin adapted to be inserted into a hole formed in the tongue of the belt; and a buckle frame coupled to the buckle stock, the buckle frame comprising an opening adapted to receive at least the tongue of the belt, the buckle frame further comprising a pin seat adapted to maintain the buckle pin in a releasably secured position when the buckle pin is inserted through the hole of the belt.

9. A belt assembly for wearing around a waist of a wearer, the belt assembly comprising:

a belt for wearing around a waist of a wearer; and a buckle assembly comprising:

a base member including a male portion, the base member independently coupled to the belt at a distal end of the belt; and a buckle attachment comprising a lateral side and a longitudinal side, the buckle attachment including a female portion disposed on at least a portion of the longitudinal side, wherein the base member is removably coupled to the buckle attachment by slidably coupling the male portion of the base member and the female portion of the buckle attachment along an axis defined by a longitudinal axis of the female portion, and wherein the longitudinal axis of the female portion extends along the longitudinal side of the buckle attachment, and wherein the buckle attachment is adapted to releasably secure to the belt for fastening the belt around the waist of the wearer.

10. The belt assembly of claim 9 wherein the buckle assembly further comprises a detent coupled to the base member, the detent adapted to be inserted into a detent recess formed in the female portion, the detent operable with the detent recess to resist uncoupling of the base member from the buckle attachment, the base member is slidably coupled to the buckle attachment.

11. The belt assembly of claim 10 wherein the base member further comprises a detent spring, the detent spring adapted to bias the detent toward the detent recess when the base member is coupled to the buckle attachment.

12. The belt assembly of claim 10 wherein the buckle assembly further comprises a detent actuator adapted to bias the detent along the longitudinal axis defined by the female portion of the buckle attachment, the biasing of the detent operable to release the detent from the detent recess.

13. The belt assembly of claim 10 wherein the buckle assembly further comprises a detent spring adapted to bias the detent toward the detent recess when the base member is coupled to the buckle attachment.

14. The belt assembly of claim 9 wherein the female portion is substantially cylindrical, and wherein the male portion is substantially cylindrical.

15. The belt assembly of claim 9 wherein the buckle assembly is configured to allow a portion of the belt to pass through the buckle assembly.

16. The belt assembly of claim 9 wherein the buckle assembly is configured to allow a portion of the belt to pass adjacent to the buckle assembly.

17. The belt assembly of claim 9, wherein the longitudinal axis is parallel to the longitudinal side of the buckle attachment.

18. The belt assembly of claim 9 wherein the buckle assembly further comprises:

a buckle stock comprising a lateral side and a longitudinal side, the buckle stock including a female portion disposed on at least a portion of the longitudinal side, wherein the base member is removably coupled to the buckle attachment by slidably coupling the male portion of the base member and the female portion of the buckle stock along an axis defined by a longitudinal axis of the female portion, and wherein the longitudinal axis of the female portion extends along the longitudinal side of the buckle stock;

a buckle pin coupled to the buckle stock, the buckle pin adapted to be inserted into a hole formed in the tongue of the belt; and a buckle frame coupled to the buckle stock, the buckle frame comprising an opening adapted to receive at least the tongue of the belt, the buckle frame further comprising a pin seat adapted to maintain the buckle pin in a releasably secured position when the buckle pin is inserted through the hole of the belt.

* * * * *